United States Patent [19]

Freisinger et al.

[11] Patent Number: 5,044,657

[45] Date of Patent: Sep. 3, 1991

[54] SAFETY SKI BINDING

[75] Inventors: Henry Freisinger; Egon Brunnhuber, both of Vienna, Austria

[73] Assignee: TMC Corporation, Barr, Switzerland

[21] Appl. No.: 466,350

[22] PCT Filed: Jun. 15, 1989

[86] PCT No.: PCT/EP89/00670

§ 371 Date: Mar. 2, 1990

§ 102(e) Date: Mar. 2, 1990

[87] PCT Pub. No.: WO90/00078

PCT Pub. Date: Jan. 11, 1990

[30] Foreign Application Priority Data

Jul. 4, 1988 [AT] Austria ..... 1720/88

[51] Int. Cl.[5] ..... A63C 9/081

[52] U.S. Cl. ..... 280/625

[58] Field of Search ..... 280/625, 618, 629

[56] References Cited

U.S. PATENT DOCUMENTS

| | | | |
|---|---|---|---|
| 4,735,434 | 4/1988 | Sedlmair | 280/625 |
| 4,779,891 | 10/1988 | Freisinger et al. | 280/625 |
| 4,861,064 | 8/1989 | Stritzl et al. | 280/618 |
| 4,930,802 | 6/1990 | Sedlmair | 280/625 |

FOREIGN PATENT DOCUMENTS

| | | | |
|---|---|---|---|
| 3539969 | 5/1987 | Fed. Rep. of Germany | 280/625 |
| 8202495 | 8/1982 | World Int. Prop. O. | 280/625 |

*Primary Examiner*—David M. Mitchell

*Attorney, Agent, or Firm*—Flynn, Thiel, Boutell & Tanis

[57] ABSTRACT

A safety ski binding having a horizontally pivotal sole plate provided with a heel holder for the heel of a ski boot and two two-arm sole holders pivotal about sole holder axles to the sole plate. One of the two lever arms engages the edge of the sole of the toe portion of the ski boot. The movement of a second one of the lever arms is restricted by a locking and control element controlled by a stop surface provided on the housing. The second lever arm is released beyond a specific angle of traverse during an outward pivoting of the sole plate. The locking and control element is arranged pivotally on an axle located between the two sole-holder axles. The locking element is approximately heart-shaped and has support surfaces engaging the two sole holders. A housing for the toe part of the binding is longitudinally movable and the control element is a rod extending forwardly into a cavity provided in the housing, which rod engages a stop surface in the housing in a pivoted position of the sole plate.

8 Claims, 4 Drawing Sheets

SAFETY SKI BINDING

FIELD OF THE INVENTION

The invention relates to a safety ski binding having sole plate.

BACKGROUND OF THE INVENTION

A known safety ski binding is for example described in W082/02495 (see FIGS. 14, 15). The sole holders in this conventional ski binding are constructed as angle levers, each pivotal about a vertical axis, the one leg of which angle levers holds the ski boot sole, while each angle lever is pivotally supported on the other leg. The ends of the angle levers, which ends are directed toward one another, are connected hingedly with one another and are biased in loading direction of the ski binding by a torsion spring. The free ends of the angle levers are directed forwardly. During a pivoting of the sole plate, the free end of one angle lever comes into contact with a ski-fixed stop causing a horizontal pivoting of the angle levers and of the sole holders.

This known ski binding has the disadvantage that the front jaw consists of many individual parts movable relative to one another. On the one hand, this can cause friction forces, which are difficult to control, to occur at many points. On the other hand, the manufacture of a ski binding consisting of so many individual parts is also expensive. In particular this conventional ski binding requires, for the return of the locking elements and of the sole holder after a safety release, a return spring separate from the release spring mounted in the heel holder and controlling the lever movement. Furthermore, this conventional ski binding enables in the case of a bending of the ski, due to unevennesses in the terrain, only a slight longitudinal compensation before a jamming occurs.

A slightly different solution is known from Austrian Patent No. 372 867. The sole holders in this ski binding are supported in a skiing position on a ski-fixed abutment. This causes the abutments to apply an excessive pressure on the sole holders when the ski is bent, which pressure is transmitted by the sole holders onto the ski-boot sole. This can lead to stress/deformations and thus to worsened skiing characteristics and release values.

SUMMARY OF THE INVENTION

The goal of the present invention is to avoid the mentioned disadvantages and to provide a ski binding of the above-mentioned type which is compact and has a reduced number of individual structural parts. Furthermore, stress/deformations of the ski boot sole or rather a jamming of binding parts during a bending of the ski are to be reliably avoided.

The set purpose is attained according to the invention by constructing the locking and the control element to be pivotally supported on an axis arranged centrally between the sole-holder bolts on the sole plate to result in a compact design of the ski binding having a small number of structural parts. By arranging the rod-shaped control elements in a cavity of the longitudinally movable housing, a stress/deformation of the ski-boot sole or a jamming of the binding base plate is reliably avoided. A housing movably arranged in a longitudinal direction of the ski is known by itself from Austrian Patent No. 384 950.

BRIEF DESCRIPTION OF THE DRAWINGS

Further advantages and details of the invention will be described in greater detail in connection with the drawings, which illustrate one exemplary embodiment.

In the drawings.

DETAILED DESCRIPTION

The terms front, rear, left and right in the following description refer to the direction of travel of the ski binding, namely, front means directed toward the tip of the ski, etc.

Figure 1:
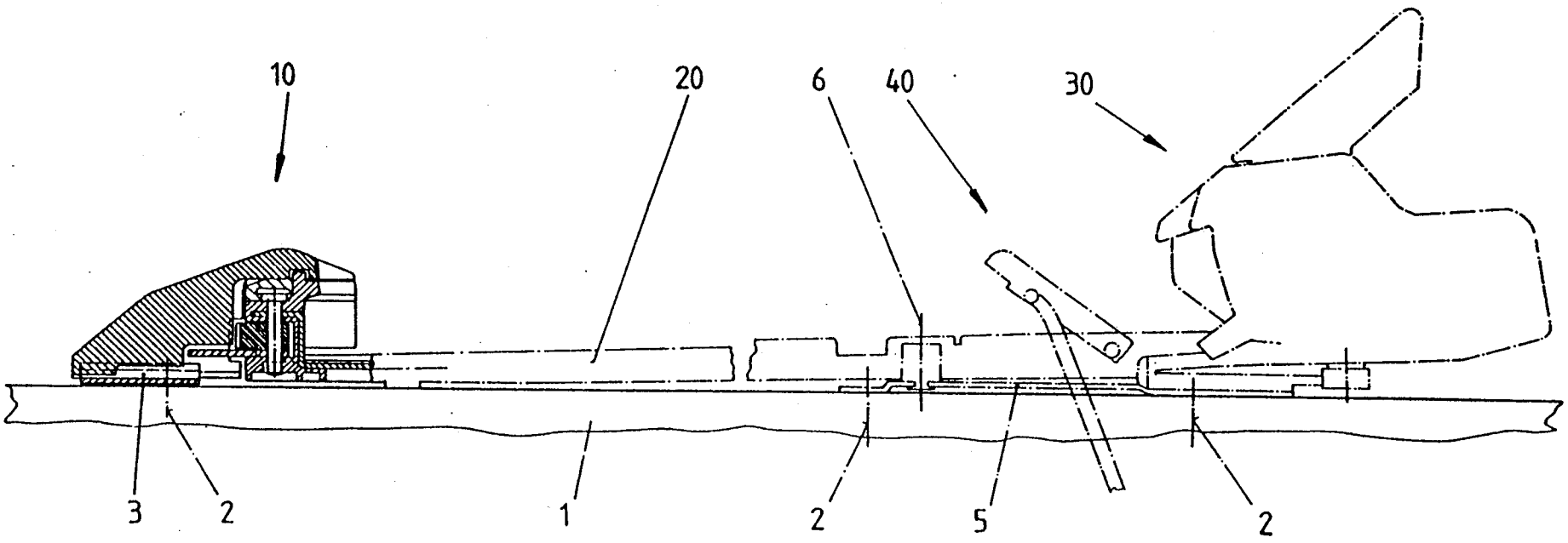
FIG. 1 is a longitudinal cross-sectional view of the ski binding of the invention.

FIG. 1 shows a complete safety ski binding, which will be described in greater detail hereinafter. The parts identified by dash-dotted lines are not part the subject matter of the invention and have been illustrated only for a better understanding. A base plate 3 for a front jaw 10 and a mounting plate 5 for a sole plate 20 pivotally supported in a conventional manner on a pivot pin 6 are fastened on a ski 1 by means of screws 2, which are only partially indicated. The sole plate 20 carries furthermore a heel holder 30 and a ski brake 40, both of a known construction. They are not part of the subject matter of the invention and are therefore also not described in detail.

Figure 2:
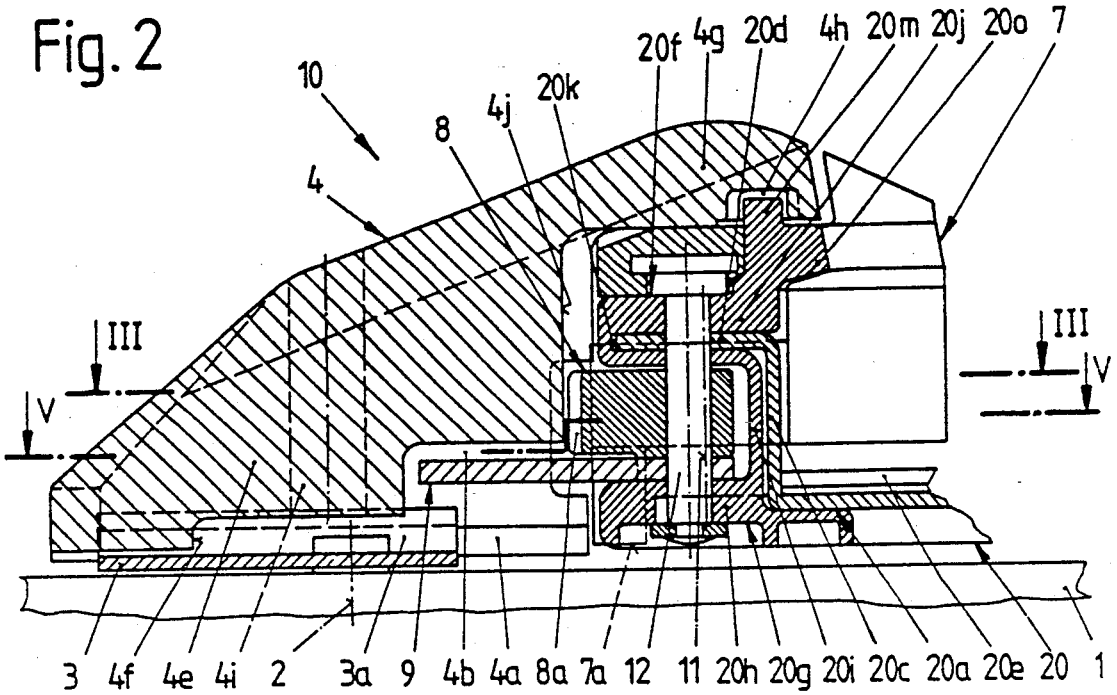
FIG. 2 illustrates the front jaw according to FIG. 1 in an enlarged scale.
Figure 3:
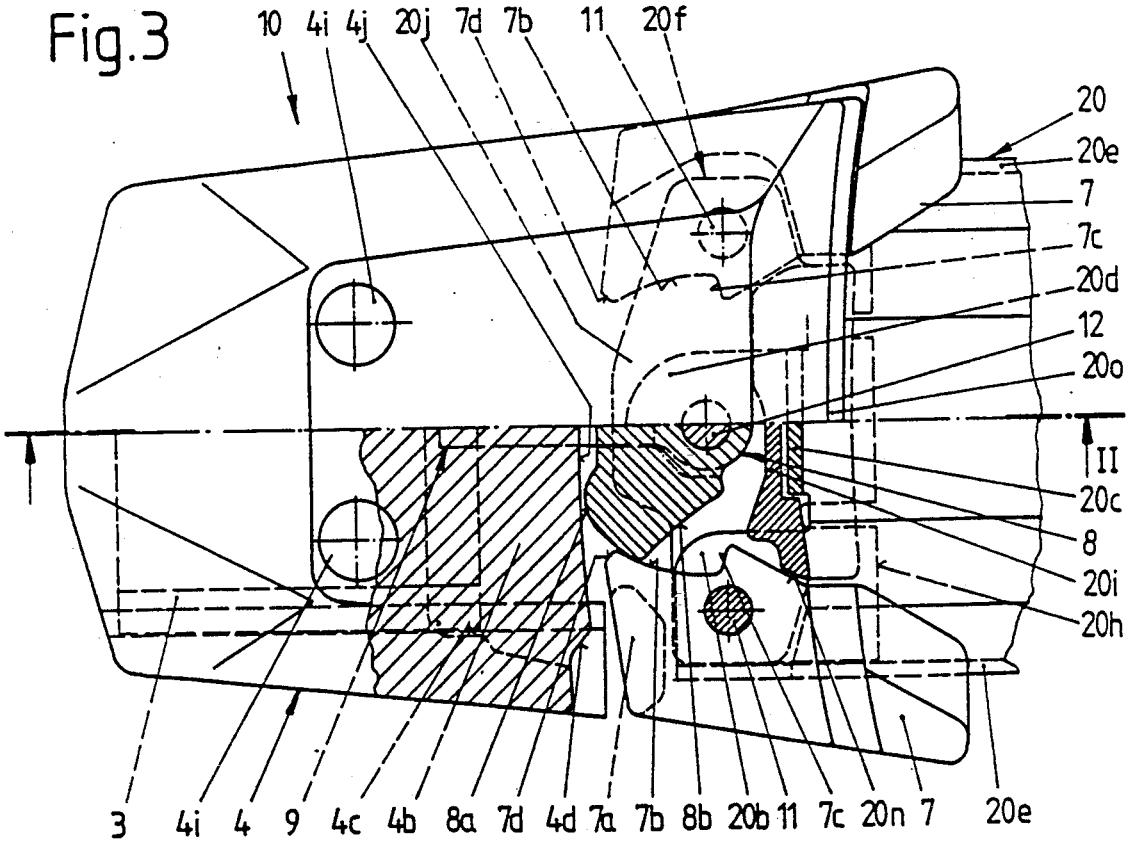
FIG. 3 is a top view thereof, partially in cross section taken along the line III—III of FIG. 2.

The front jaw 10 of the invention is illustrated in the travelling position of the ski binding in FIGS. 2 and 3. The base plate 3 has upwardly projecting guide rails 3*a* extending in longitudinal direction of the ski on both sides. A housing 4 is supported longitudinally movably, however, not removably on the base plate 3 by means of its base 4*a*. A cavity 4*b*, for parts of the front jaw 10 to be described later on, is provided in the rear area of the housing 4. The cavity 4*b* has stop surfaces 4*c* adjacent its lateral edges. A path-limiting means 4*f* exists on the underside of the housing 4 in its front area 4*e*, which path-limiting means 4*f* lies in a plane extending transversely with respect to the longitudinal direction of the ski and perpendicularly with respect to the upper side of the ski. This path-limiting means enables, with the head of the screw 2, a correct positioning of the housing 4 relative to the base plate 3 during the length adjustment of the ski binding. A guide groove 4*h* is recessed in the upper 4*g* of the housing 4 on the side facing the cavity 4*b*. The guide groove 4*h* extends along a circular ring sector, the centerline of which is drawn along a circle, the centerpoint of which circle lies in the axis of the pivot pin 6. Through-holes 4*i* for the screws 2 are furthermore provided in the housing 4. A transversely extending inner wall 4*j* of the cavity 4*b* has one cam 4*d* on each side.

A front end area 20*a* of the sole plate 20 is constructed as a bearing point for the sole holder 7 and a release mechanism to be described in greater detail later on. The sole plate 20 has for this purpose at its front end area 20*a* forwardly extending plates 20*b*. A vertically extending section 20*c* extends in the central region of the front end area 20*a* of the sole plate 20. A forwardly directed horizontal section 20*d* follows the vertical section 20*c*. The sole plate 20 has furthermore sides guideways 20*e* (not described in detail here) for a not illustrated rear sole plate part. A support element 20*f* is constructed with the front end area 20*a* of the sole plate 20 as a bearing unit 20*g*. A lower horizontal area 20*h* of the support element 20*f* extends partly below the sole plate 20, partly in front of same. A vertical region 20*i* follows, which vertical region 20*i* extends at least partly parallel with respect to the vertical section 20*c* of the front end area 20*a* of the sole plate 20. The vertical region 20*i* of the support element 20*f* has on both sides inclined extending contact surfaces 20*n* for the sole holders 7. An upper horizontally extending region 20*j* following the vertical region 20*i* of the support element 20*f* extends substantially over the width of the front end area 20*a* of the sole plate 20. A slot 20*k* exists in the upper horizontal region 20*j*, into which slot 20*k* extends the horizontal section 20*d* of the front end area 20*a* of the sole plate 20. The upper horizontal region 20*j* has furthermore an upwardly projecting projection 20*m* extending with clearance into the guide groove 4*h* of the housing 4. The upper horizontal region 20*j* is constructed as a sole down-holder 20*o* on the side facing the ski boot.

A vertically extending central axle 12 and two also vertically extending sole holder bolts 11 are anchored in the bearing unit 20*g*. The sole holders 7 are their rear area equipped with contact surfaces for the ski boot soles in a conventional and therefore not in detail described manner. The sole holders 7 have at their front end downwardly directed pins 7*a*, the function of which will be described in greater detail later on. The sole holders 7 are constructed curvelike in the top view in their front region on their side facing the longitudinal axis of the ski, with each curve 7*b* ending in a latch stop surface 7*c*. A snap-off edge 7*d* is provided on the end of the curve 7*b* remote from the latch stop 7*c*.

Figure 4:
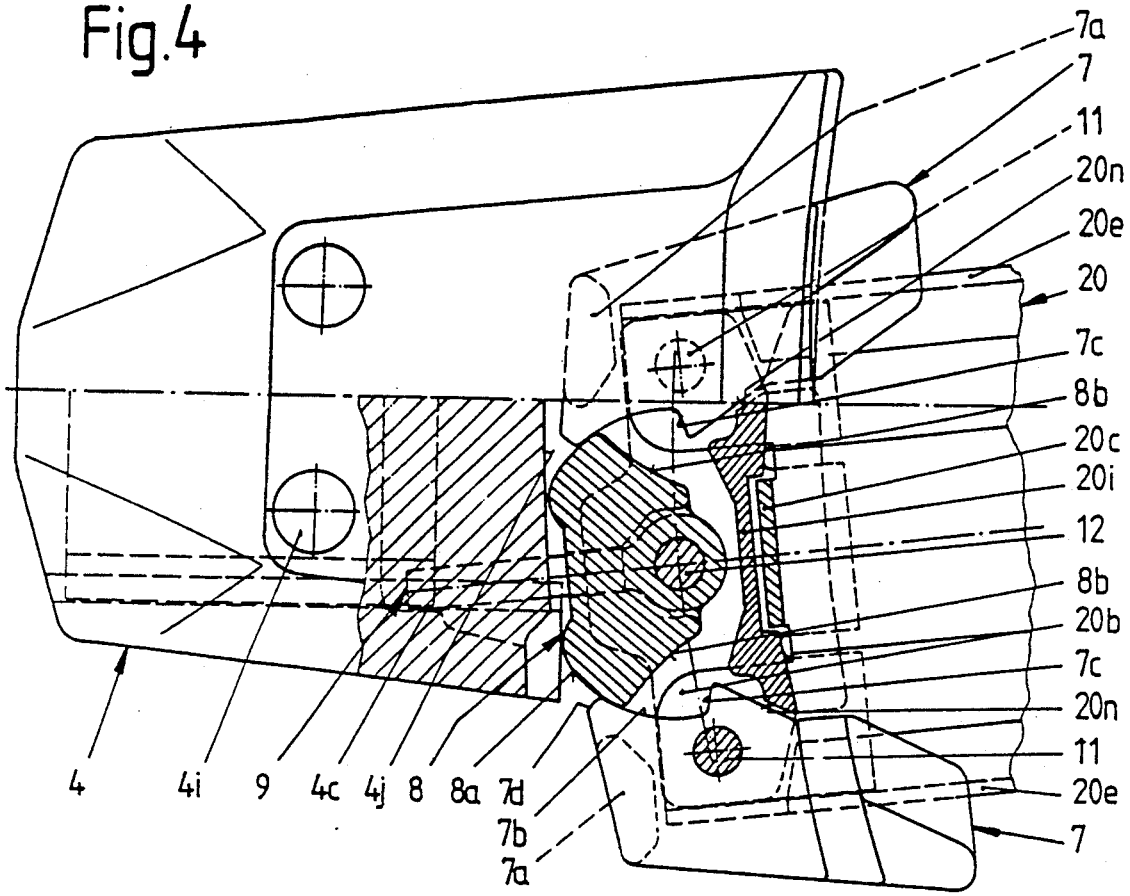
FIG. 4 shows the front jaw with a partially pivoted sole plate.
Figure 5:
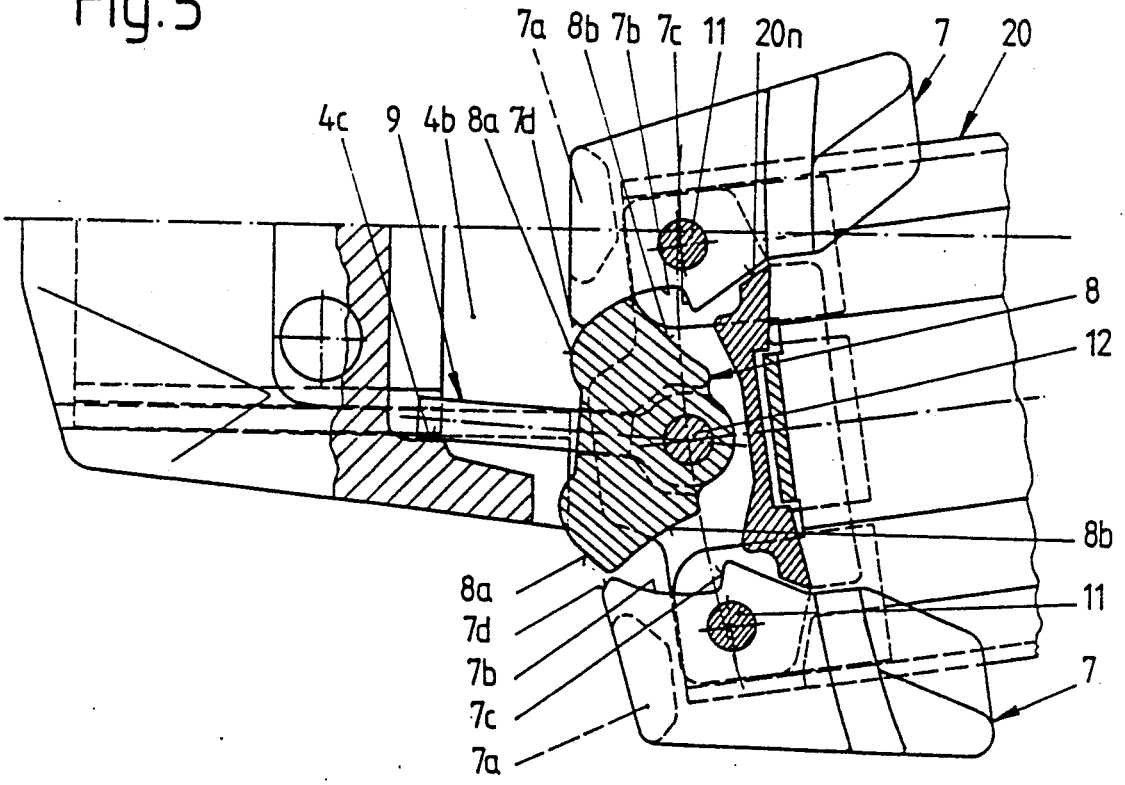
FIG. 5 illustrates the front jaw at the release point, partially in cross section taken along the line V—V of FIG. 2.
Figure 6:
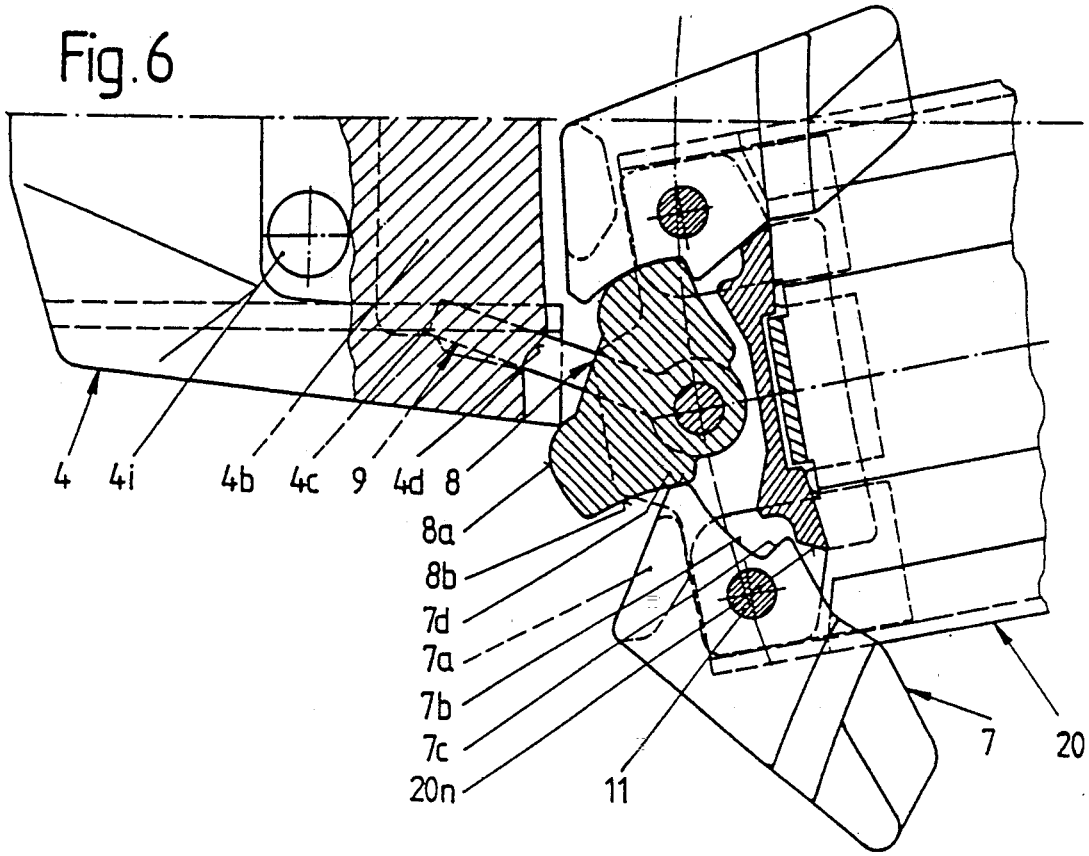
FIG. 6 illustrates the front jaw after the release occurred.

A locking element 8 and a control element 9 pivotal together with the locking element 8 are pivotally supported on the axle 12. The locking element 8 is designed approximately heart-shaped in the top view and has arches 8*a* and converging curved surfaces 8*b*. The control element 9 is designed approximately rod-shaped and extends, viewed in the travelling position of the ski binding, in the region of the longitudinal axis of the ski from the axle 12 forwardly. If a lateral load occurs, the sole plate 20 is pivoted. It thereby carries along the locking element 8 and the control element 9. As soon as the control element 9 has reached the stop surface 4*c* (see FIG. 4), it starts to pivot about the axle 12 together with the locking element 8. At a force exceeding the elasticity range of the ski binding, the sole plate 20 on the one side and the unit of locking element 8 and control element 9 on the other side are pivoted on until the sole holder 7, which leads viewed in the pivoting direction, with its snap-off edge 7*d* is released from the region of the arch 8*a* of the locking element 8 (see FIG. 5) and releases without any further force the ski boot here not illustrated. An excessive rotation of the locking element 8 and thus of the sole plate 20 is thereby prevented by the locking element 8 with its curved surface 8*b* remote from the pivoting direction resting on the latch stop surface 7*c* of the associated sole holder 7. The pin 7*a* limits thereby the rotating movement of the sole holder 7 (see FIG. 6).

Figure 7:
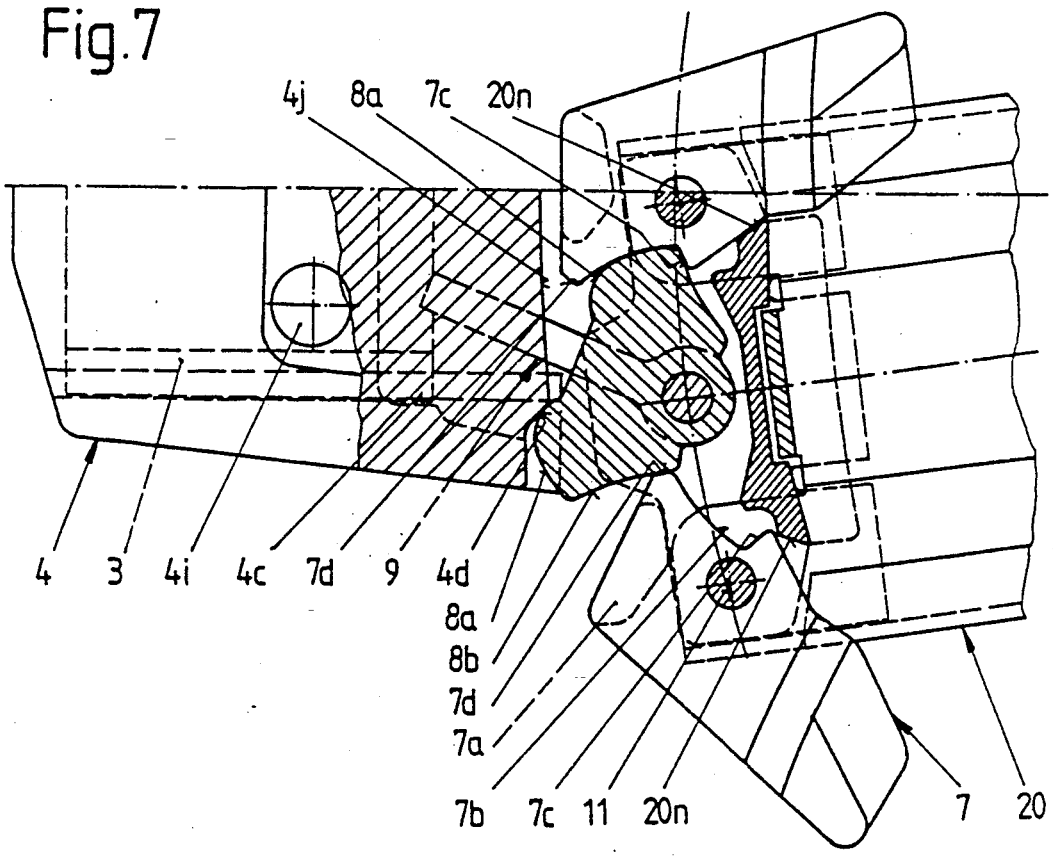
FIG. 7 illustrates the front jaw during the return movement.

If the sole plate 20, after a safety release, is now returned into the centered position (travelling position) (see FIG. 7), the associated arch 8*a* of the locking element 8 comes into contact with a cam surface 4*d* on the housing 4. During a further return pivoting of the sole plate 20, the locking element 8 together with the control element 9 and, simultaneously, through the cooperation between the snap-off edge 7*d* of the sole holder 7 and the associated curved surface 8*b* of the locking element 8, the also swung-out sole holders 7 are thus returned into the initial position.

The embodiments of the invention in which an exclusive property or privilege is claimed are defined as follows:

1. In a safety ski binding comprising a sole plate pivotal about a ski-fixed pivot pin in a horizontal plane, on which sole plate is adapted to be supported a ski boot, a heel holder mounted on said sole plate and adapted to hold a heel end region of the ski boot, and two two-arm sole holders pivotally mounted on vertically extending axles on said sole plate for holding a toe region of the ski boot, a first lever arm of each sole holder engaging a sole edge on opposite lateral sides of the toe of the ski boot, a second lever arm of each sole holder engaging a locking element, a pair of transversely spaced stop surfaces arranged fixed to the ski, so that at least one of said stop surfaces, after a pivoting of the sole plate through a specific range, will effect a release of the edge of the sole of the ski boot, the improvement wherein means are provided on each sole holder defining a curved surface, wherein said locking element is pivotally supported on a further axle arranged between said axles for pivotally supporting the sole holders on said sole plate and extending parallel to said axles, said locking element having a pair of laterally spaced, forwardly facing, arched surfaces with following and a pair of laterally facing curved surfaces, each contiguous with a respective one of said arched surfaces to thereby define support surfaces adapted to engage said two sole holders in both a travelling position thereof and an outward pivoted ski boot release position thereof, said curved surface on each sole holder directly abutting a respective one of said arched surfaces in said travelling position, wherein a housing is provided and covers both a portion of said sole holders in the travelling position, a ski-fixed base plate having support means thereon for supporting said housing for movement parallel to a longitudinal axis of the ski, and wherein an elongated rod-shaped control element is provided on said locking element, a longitudinal axis of which control element intersects said further axle pivotally supporting said locking element and extends, in said travelling position, generally parallel to a longitudinal axis of said sole plate, said housing also having said pair of stop surfaces provided thereon, said control element engaging in the pivoted position of said sole plate a respective one of said pair of stop surfaces to facilitate said locking element pivoting about said further axle support therefor to further facilitate one of said sole holders pivoting to the ski boot release position to allow the ski boot to be released from said ski binding.

2. The binding according to claim 1, wherein said control element has at its end adjacent said locking element a bearing eye, which together with said locking element is supported on said further axle.

3. The binding according to claim 1, wherein said stop surfaces are provided on lateral inside walls of said housing.

4. The binding according to claim 1, wherein on the underside of said housing in a front region thereof there is provided a path-limiting means lying in a plane which extends transversely with respect to the longitudinal axis of the ski and perpendicularly with respect to an upper side of the ski, for limiting the movement and positioning of said housing during a length adjustment of said ski binding.

5. The binding according to claim 1, wherein said housing is provided with a transversely extending inner wall portion having a cam surface at each lateral end thereof, a respective one of said arched surfaces on said locking element engaging a one of said cam surfaces during a lateral outward pivoting of said sole plate.

6. The binding according to claim 1, wherein a guide groove is provided on an inner side of an upper region of said housing, which guide groove extends along a circular path, the center of which is congruent with an axis of said ski-fixed pivot pin, into which guide groove is received with clearance an upwardly projecting projection provided on an upper horizontal region of said sole plate, and wherein said housing is movable in a longitudinal direction of said ski relative to said base plate.

7. The binding according to claim 1, wherein said upper horizontal region is provided on a support element which extends substantially over the width of a front end region of said sole plate.

8. The binding according to claim 1, wherein said second lever arms of each sole holder have adjacent their free ends a downwardly directed pin defining a further stop, and wherein each said second arms, on a side thereof facing a centerline of the ski, having a said curved surface abutting a said arched surface on said locking element in the travelling position thereof, wherein each curved surface terminates in a latch stop surface, and wherein each said curved surface has, at its end remote from said latch stop surface, a snap-off edge, said curved surface slidingly moving along said arched surface on said locking element as said sole plate is moved about its pivotal support until said snap-off edge is reached, beyond which said sole holder is allowed to move fully to the released position of said binding and allowing said pin to engage a stop therefor on said sole plate to limit further outward pivoting of said sole holder relative to said sole plate.

* * * * *

UNITED STATES PATENT AND TRADEMARK OFFICE

CERTIFICATE OF CORRECTION

PATENT NO. : 5 044 657

DATED : September 3, 1991

INVENTOR(S) : Henry FREISINGER et al.

It is certified that error appears in the above-identified patent and that said Letters Patent is hereby corrected as shown below:

Column 4, line 39; delete "with following".

Signed and Sealed this

Fourth Day of May, 1993

*Attest:*

Michael K. Kirk

MICHAEL K. KIRK

*Attesting Officer*

*Acting Commissioner of Patents and Trademarks*